US007465126B2

(12) United States Patent
Werners et al.

(10) Patent No.: US 7,465,126 B2
(45) Date of Patent: Dec. 16, 2008

(54) SUPPORTING DEVICE COMPRISING JOINTED ARMS

(75) Inventors: Henri Frans Theo Werners, Bilthoven (NL); Marten Fluks, Vlanen (NL); Maria Cornelis Wilhelmus Marinus Van Den Oetelaar, Olsterwijk (NL)

(73) Assignee: Bosch Rexroth AG, Lohr (DE)

( * ) Notice: Subject to any disclaimer, the term of this patent is extended or adjusted under 35 U.S.C. 154(b) by 1523 days.

(21) Appl. No.: 10/239,006

(22) PCT Filed: Mar. 12, 2001

(86) PCT No.: PCT/DE01/00924

§ 371 (c)(1),
(2), (4) Date: Apr. 9, 2003

(87) PCT Pub. No.: WO01/68443

PCT Pub. Date: Sep. 20, 2001

(65) Prior Publication Data

US 2004/0025777 A1 Feb. 12, 2004

(30) Foreign Application Priority Data

Mar. 17, 2000 (DE) ..... 100 13 333
May 30, 2000 (DE) ..... 100 26 727

(51) Int. Cl.
*E02B 17/00* (2006.01)

(52) U.S. Cl. ..... 405/204; 405/209

(58) Field of Classification Search ..... 405/195.1, 405/203, 204, 209
See application file for complete search history.

(56) References Cited

U.S. PATENT DOCUMENTS 5,662,434 A * 9/1997 Khachaturian ..... 405/204
5,829,919 A * 11/1998 Heerema ..... 405/209
5,975,807 A * 11/1999 Khachaturian ..... 405/204
6,149,350 A * 11/2000 Khachaturian ..... 405/204
6,171,028 B1 * 1/2001 Van Gelder ..... 405/209
6,840,713 B1 * 1/2005 Schia et al. ..... 405/209

FOREIGN PATENT DOCUMENTS

FR 1 332 358 6/1963
FR 2 747 989 4/1997

* cited by examiner

*Primary Examiner*—Frederick L Lagman
(74) *Attorney, Agent, or Firm*—Boyle Fredrickson S.C.

(57) ABSTRACT

There is disclosed a support means, especially for mounting or dismounting an offshore platform, comprising an articulated bracket which is movable horizontally swinging its two articulated arms. In the case of a rather rough sea a compensating movement in the horizontal direction can be effected by appropriately controlling the articulated arms, wherein the reaction forces acting in the horizontal direction are minimal.

15 Claims, 4 Drawing Sheets

SUPPORTING DEVICE COMPRISING JOINTED ARMS

The invention relates to a support means, especially for mounting or dismounting an offshore platform.

Usually offshore platforms, for instance drilling and production platforms, are placed onto a supporting structure anchored in the ocean bed.

Many of the presently existing platforms have reached the end of their calculated life and have to be transported from their site to a shipyard in the coastal area for dismantling or renovation. It is preferred in such cases that the platforms can be transported as a whole instead of dismantling them into smaller units in situ.

For mounting and dismounting the platform, a support means which is disposed, for instance, on a special purpose ship is employed. In such special purpose ship the bow is designed to have two hull members like a catamaran the distance of which is chosen such that the drilling platform is accommodated between the two hull members. The support means through which the drilling platform is adapted to be lifted or lowered are arranged on the two hull members.

In the document U.S. pat. No. 4,744,697 there is described a solution in which the platform can be lifted and/or lowered by means of a number of cranes arranged in pairs. The two cranes of one pair are disposed diametrally with respect to each other on the two hull members and jointly bear a bracket on which the drilling platform is supported.

What is a drawback of this solution is the fact that the platform is not fixed in the horizontal direction via the crane cables of the cranes so that in a rough sea the platform can fall into horizontally directed oscillating movements which substantially impede the placing of the platform upon the supporting structure.

In the documents U.S. pat. No. 5,829,919 and WO 98/24980 A1 improved support means are shown, wherein brackets laterally projecting toward the platform are used instead of the cranes. Such brackets are guided on rails of the two hulls via roll bodies or wheels so that they are extendable from an inner transporting or home position to the outside toward the platform. At the freely projecting end portion of the brackets lifting means are arranged. These can be designed, in accordance with WO 98/24980 A1, such that the platform is fastened to hang on the brackets, whereas in the solution disclosed in U.S. pat. No. 5,829,919 the lifting means are designed as support members. For lifting or lowering the platform these lifting means are extended and/or retracted in vertical direction by one or more hydraulic cylinders.

When mounting/dismounting the platforms it is a problem that the mounting/dismounting is not only to be carried out in dead light winds but also under more difficult weather conditions. In a rough sea the special purpose ship makes movements within the six degrees of freedom existing, wherein the motion components effective in the horizontal direction can be reduced but not completely compensated by appropriate stabilizing means such as tugs, anchor systems, fenders or the like. The compensation of the motion components effective in the vertical direction is comparatively simple, as this can be effected through the lifting means themselves which can be controlled in response to the vertical movement of the special purpose ship or the platform.

The compensation of the motions of the ship in the horizontal direction is especially difficult when the lifting means act already upon the platform so that the horizontal balancing movement of the brackets is to be made even during an extremely high load in the vertical direction, the weight of a platform can be up to 50000 tons.

In the case of the solutions disclosed in U.S. pat. No. 5,829,919 and WO98/24980 A1 the motion components effective in the transverse direction of the special purpose ship can be introduced via the support wheels of the brackets guided on rails so that the lateral forces are minimal. Instead of such wheels also high-quality sliding bearings or hydrostatic bearings can be used. However, such bearing arrangements require considerable technical equipment, need much space and are relatively expensive so that alternative solutions are looked for. For compensating the horizontal movement it is moreover suggested in WO98/24980 A1 to design the articulated arms of the lifting means to have a certain play so as to be able to deflect the adapter acting upon the platform in the horizontal plane. However, this play is adapted to compensate relatively small horizontal movements only.

SUMMARY OF THE PRESENT INVENTION

In view of the above-noted drawbacks, the preffered embodiment provides a support, especially for mounting or dismounting an offshore platform, which permits a simple compensation of horizontal movements.

This object is achieved by a support means comprising the features of claim 1.

In accordance with the invention, a bracket of the support means is designed to have two pivoted arms that are movable into the lifted position in the horizontal direction. By moving these two arms a compensation of the movement of the ship in the horizontal direction is permitted in an extremely simple manner so that an exact coupling to the drilling platform is ensured. It is further reached that even in a rough sea and with high loads only low forces acting in the lateral and longitudinal directions act upon the ship and the supporting structure anchored in the ocean ground so that there is a minimum risk of damaging all elements.

It is another advantage of the design according to the invention that the articulated connection of the bracket can be materialized at comparatively low costs, wherein the bracket can be retracted in an articulated manner in the home position and thus requires only a minimum space.

The articulated brackets according to the invention are preferably hinged to the hull members of a special purpose ship, of a similar floating body or to a mounting/dismounting apparatus anchored in the ocean ground. In principle, the invention can be used for all objects, however, in which movements acting transversely to the weight have to be compensated with low admissible horizontal force components.

The swivelling of the two arms and/or of the end portion is effected by an actuating means which can be designed to include hydraulic cylinders, for instance, through which each arm can be swivelled about its swivelling axis.

The lifting means can be arranged on an end portion linked to the articulated arm so that the lifting means can be swivelled with respect to the articulated arm in the horizontal direction. Advantageously such end portion has a fork-like design so that an appropriately shaped adapter provided at the platform or the supporting structure is encompassed by the fork legs. A lifting means can be arranged on each of the two fork legs. The fork-like end portion ensures that the support means is adapted to follow horizontal relative movements between the platform and the floating body.

Due to the high weight of the platform considerable requirements are made to the bearing of the two swivelling arms. In accordance with the invention, the link joint can be formed between the swivel arm and the articulated arm and between the swivel arm and the end portion, in each case by two axially spaced bearings at least one of which includes one or more axial bearings and one radial bearing. preferably both bearings are designed to have at least one axial bearing, the axial support being advantageously effected through two or more hydraulically connected pistons. The hydraulic connection of the axial bearings ensures a constant support through both bearing members, wherein the loads of the individual axial bearings are reduced.

In an especially preferred embodiment the pistons are annular pistons which encompass the articulated axle.

The lifting means required for lifting the platform in the vertical direction can be hydraulic cylinders, for instance, or can be designed as in the prior art described in the beginning.

The joint according to the invention for connecting the articulated arm with the swivel arm or for connecting the swivel arm with the end portion is advantageously designed to have two joint clips provided at one arm/end portion and encompassing a joint projection disposed at the other arm/end portion in the axial direction. In this arrangement a play in the axial direction is provided between the joint clips and the joint projection which play permits a compensating movement in the vertical direction.

BRIEF DESCRIPTION OF THE DRAWINGS

Hereinafter two preferred embodiments of the invention are described in detail by way of diagrammatic drawings, in which.

DETAILED DESCRIPTION OF THE PREFERRED EMBODIMENT

Figure 1:
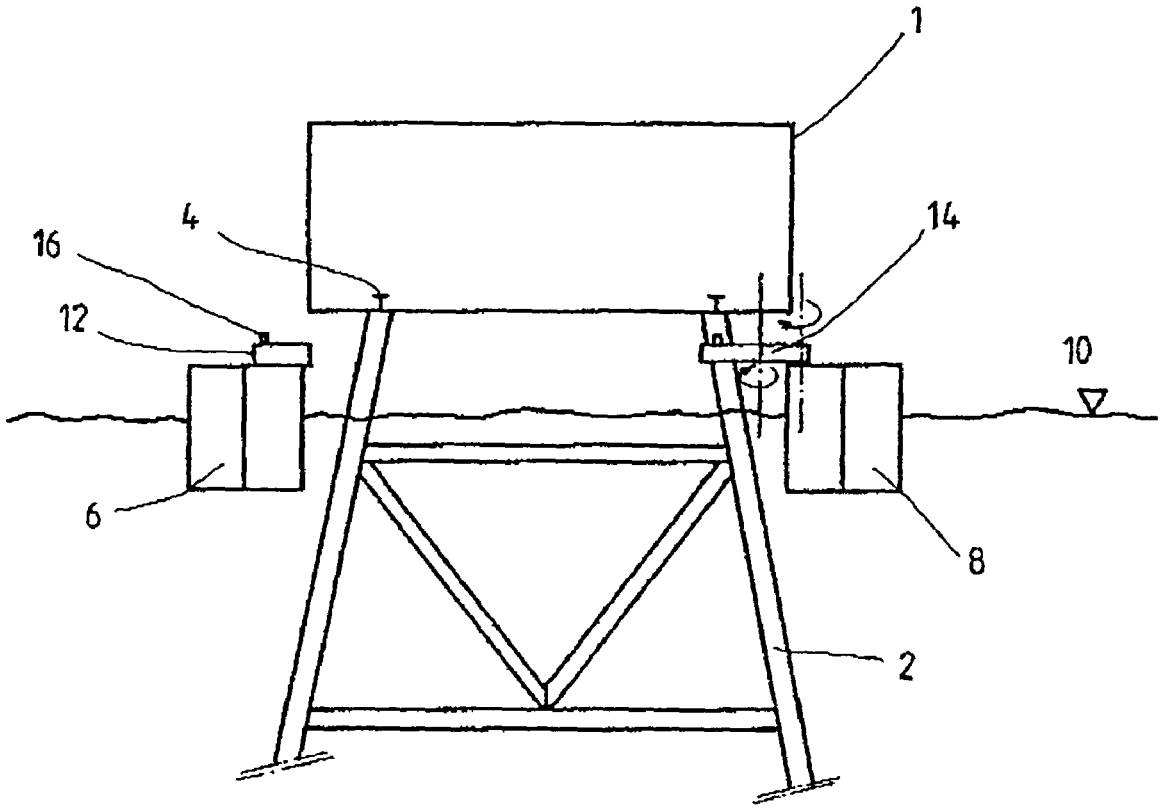
FIG. 1 shows an offshore platform including a special purpose ship for mounting/dismounting the same.

FIG. 1 shows a diagrammatic view of an offshore platform 1 which may be, for instance, a drilling or working platform. This platform is supported above the sea level on a supporting structure 2 braced in the ocean ground. To this effect the platform 1 comprises plural stiffened supporting areas 4 through which the total weight of the platform 1 which may be up to 50,000 tons is introduced into the supporting structure 2.

For mounting or lifting the platform 1 a special purpose ship is used whose bow has two spaced hull members 6, 8 the distance of which is chosen so that the platform 1 fits with the supporting structure 2 projecting from the water surface 10 between the hull members 6, 8. For lifting or lowering the platform 1 each hull member 6, 8 is provided with plural support means 12, 14 positioned in series normal to the plane of projection. In addition or as an alternative, support means can also be mounted in other positions of the ship. Each of these support means has at its free end portion a lifting means 16 through which the platform 1 can be lifted off the supporting structure 2 in the vertical direction. These lifting means 16 act, e.g., upon the reinforced supporting area 4 of the platform 1 or upon particular points of the supporting structure above the ("plane of section") parting plane.

The support means 12, 14 are formed such that they can be swivelled from a home position (12) outside the platform 1 shown on the left in FIG. 1 into a lifting or lowering position (on the right in FIG. 1, 14) in which the lifting means 16 is aligned coaxially with respect to the supporting area 4.

Instead of the hull members 6, 8 other floating bodies can be used as well.

Figure 2:
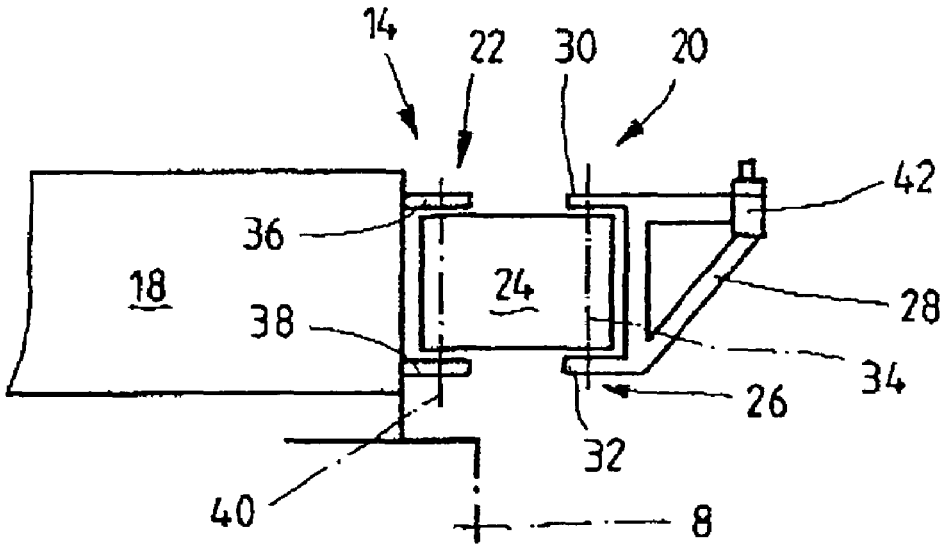
FIG. 2 shows a side view of a bracket of the support of the platform.

FIG. 2 shows a first embodiment of a support means 14 supported on the hull member 8 or 6 indicated in dash-dot. The support means 14 includes a supporting member 18 held by the hull member 8 to which a bracket 20 in the form of an articulated arm is linked via a swivel joint 22. The bracket 20 includes a swivel arm 24 connected with an articulated arm 28 provided on the outside via a joint 26. The support member 18 can be extended on the hull 6, 8 from a retracted position toward the platform in a straight line but without a load; or it may be preassembled in the desired position.

In the embodiment represented in FIG. 2 the articulated arm 28 has two joint clips 30, 32 which encompass the adjacent end portion of the swivel arm 24 and through which the common axle 34 indicated in dash-dot is passed. Correspondingly the support member 18 has two joint clips 36, 38 which encompass the other end portion of the swivel arm 24 and through which a further axle 40 is passed. The axles 34, 40 can be designed in several pieces.

In order to reduce the component weight the arms 24, 28 can be a framework construction. The lifting means 16 which is a hydraulic cylinder 42 in the represented embodiment is supported on the free end portion of the articulated arm 28. In principle, however, also parallelogram bars operable through hydraulic cylinders or lifting means as described in U.S. pat. No. 5,829,919 or WO 98/24980 A1 or other appropriate constructions could be employed.

Figure 3:
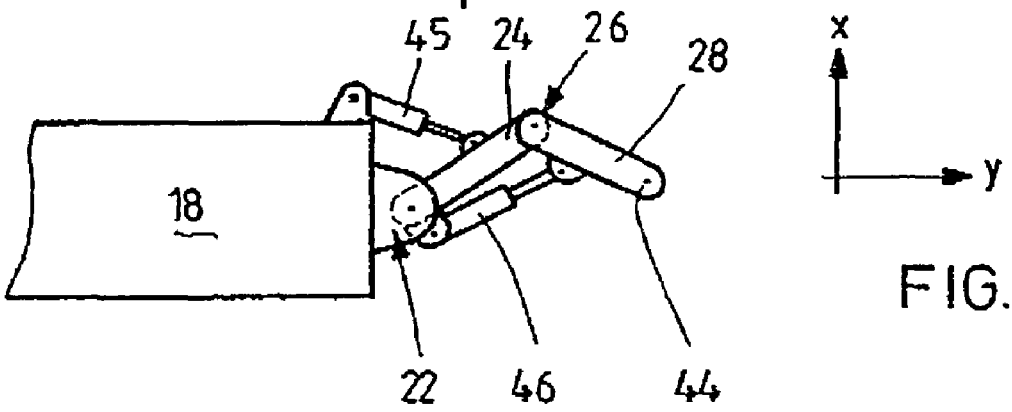
FIG. 3 is a top view on the bracket as shown in FIG. 2.

For swivelling the bracket 20 from the home position (on the left in FIG. 1) into the support position (on the right in FIG. 1) appropriate actuating means are provided which are, for instance, hydraulic cylinders 45, 46 connected to a hydraulic control. The two hydraulic cylinders 45, 46 are in turn flexibly supported on the supporting member 18 and/or the swivel arm 24. That is to say, the bracket 20 can be brought out of its folded position by extending the hydraulic cylinders 45, 46 into a position in which the lifting means is aligned with respect to the allocated supporting area 4. Depending on the extending position of the hydraulic cylinders 45, 46 practically each desired position within the swivel range can be adjusted in the horizontal plane X, Y (FIG. 3). Movements of the ship in the horizontal direction can then be simply compensated and/or admitted through the swivelling movements of the articulated arm 28 and the swivel arm 24, wherein the kinetic resistance can be adjusted by controlling the hydraulic cylinders 45, 46.

The components effective in the horizontal direction of the reaction forces transmitted to the support means when lifting the platform 1 are thus considerably smaller even in the case of great horizontal movements than in the solutions as described in the beginning in which balancing movements were possible not at all or only to a small extent or else by a considerable constructional effort and high weight and/or large dimensions.

Figure 4:
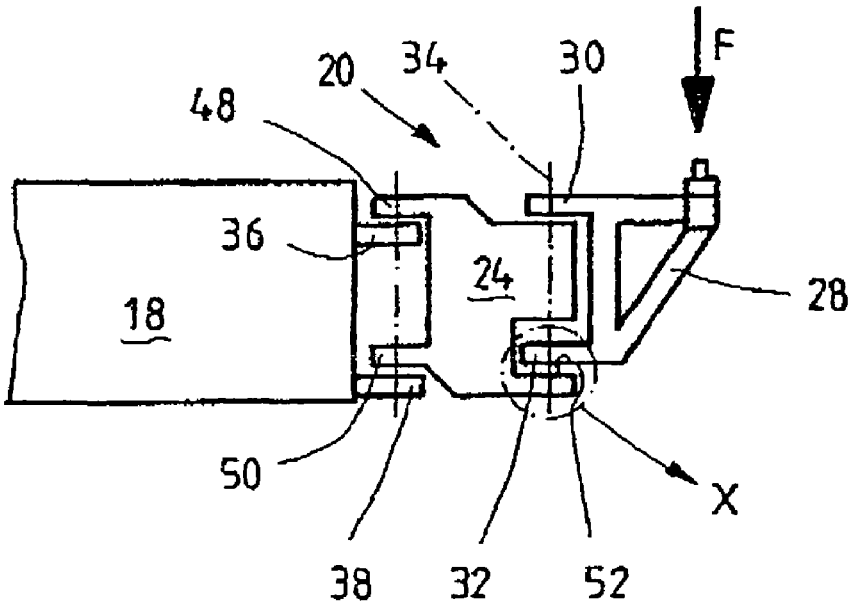
FIG. 4 shows another embodiment of the bracket as shown in FIG. 2.

FIG. 4 shows a second embodiment that differs from the aforedescribed embodiment in respect of the design of the joints 22, 26.

In the embodiment represented in FIG. 2 the articulated arm 28 and the swivel arm 24 are each supported by an axial bearing and two radial bearings (not shown), the axial bearings being formed only in the area of the clip 30 and the clip 38 of the joints 26 and 22, respectively.

In contrast to that, the articulated arm 28 and the swivel arm 24 are supported in the embodiment represented in FIG. 4 by two axial bearings which are provided in the area of the joint clips 30 and 32 of the articulated arm 28 and/or the clips 36 and 38 of the support member 18.

Joint collars 48, 50 which are supported on the allocated clips 36, 38 are formed at the swivel arm 24 in the area of the swivel joint 22.

At the other end portion of the swivel arm 24 a recess 52 into which the lower joint clip 32 immerses and is supported in the supporting direction is formed. Due to this double support in the axial direction the bearing forces can be split compared to the solution shown in FIG. 2 so that smaller and more compact individual bearings can be employed and the mechanical load of the structural parts is reduced.

Figure 5:
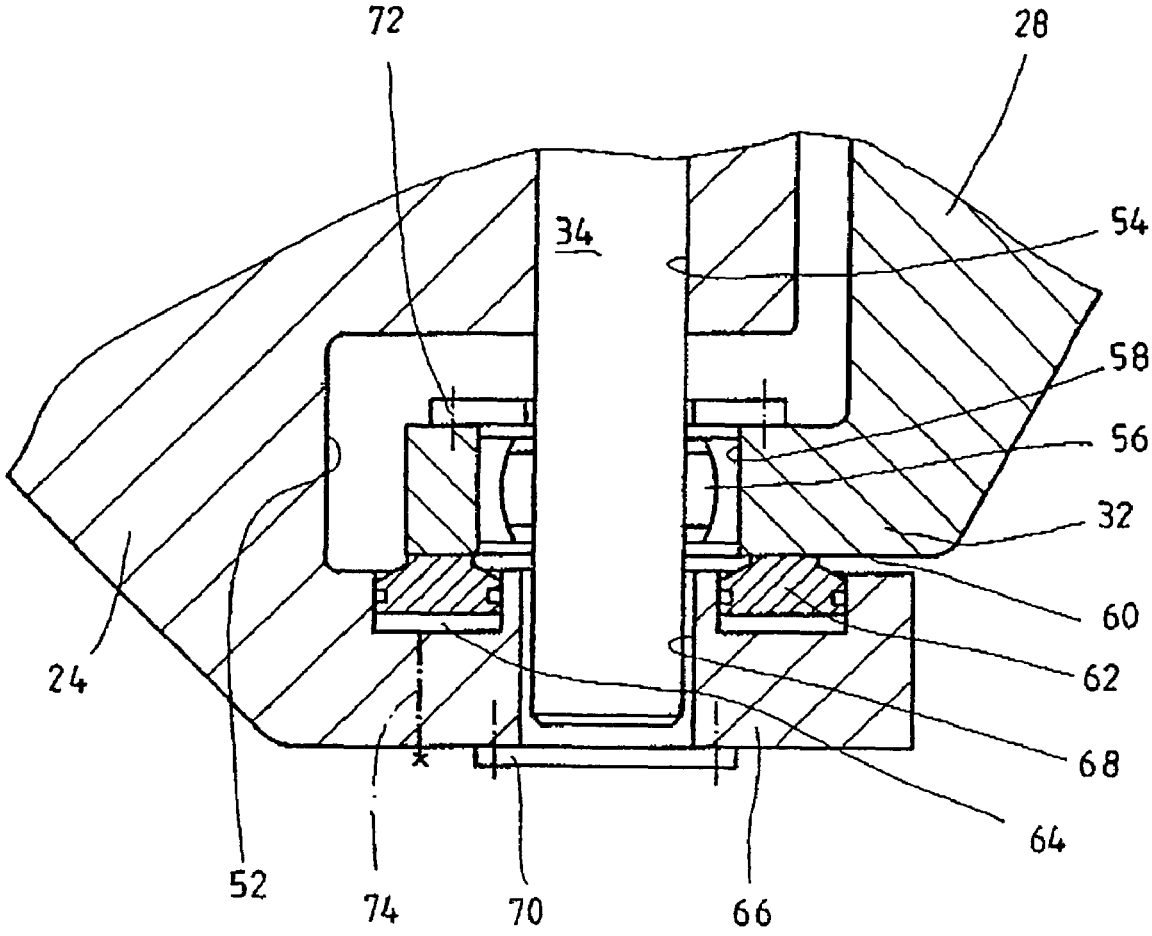
FIG. 5 is a detailed representation of an axial/radial bearing of the bracket as shown in FIG. 4.

FIG. 5 shows the lower bearing arrangement marked as detail X in FIG. 4 through which the articulated arm 28 is supported on the swivel arm 24. Such a bearing arrangement can also be used, of course, as axial/radial bearing in the embodiment shown in FIG. 2.

As described in the foregoing, the joint clip 32 of the articulated arm 28 immerses into the recess 52 of the swivel arm 24. The articulated connection of these two parts is effected through the articulated axle 34 inserted in a joint bore 54 of the swivel arm 24. The articulated arm 28 is radially supported by radial bearing 56 designed as a rolling bearing or sliding bearing which is inserted in a bearing bore 58 of the joint clip 32. The joint bore 54 can also extend into the joint clip 32.

The supporting surface 60 of the joint clip 32 positioned at the bottom in the supporting direction is supported on an annular piston 62 forming the axial bearing. This annular piston is guided in a cylinder 64 which is designed as an annular groove in a lower cheek 66 of the recess 52. Accordingly, the axial support of the articulated arm 28 is effected by the annular piston 62, while the radial support on the axle 34 is effected by the radial bearing 56. The end portion of the axle 34 positioned below immerses into a through bore or supporting bore 68 in the cheek 66. The bearing portion is sealed at the front side by sealing caps 70, 72. Corresponding bearings can also be formed in the area of the upper joint clip 30 and in the area of the clips 36, 38.

As indicated in dash-dot in FIG. 5, the cylinder chamber of the cylinder 64 is connected with the correspondingly formed cylinder chamber of the upper axial bearing (near the clip 30) through a bore 74 and a hydraulic conduit (not shown) so that the supporting forces acting in the axial direction are identical. In the same way the cylinder chambers of the axial bearings are interconnected in the area of the axle 40.

It is also imaginable to adjust an uneven distribution of the bearing forces between the cylinders by a suitable choice of the diameters of the cylinders so that, for instance, the uppermost bearing applies lower supporting forces than the axial bearing 62, 64 placed underneath as represented in FIG. 5.

By controlling the amount of fluid in the cylinders 64 a certain position in the axial direction can be adjusted.

For each swivelling axle possibly even more than two axial bearings according to the aforedescribed design can be used, wherein the hydraulic chambers thereof are interconnected so that the axial load of each bearing is reduced.

The configuration of the support means according to the invention permits, for instance, to determine the bracket 20 by a suitable control of the hydraulic cylinders 45, 46 in a particular swivelling position so that the platform is reliably fixed in the lifted state. Moreover the control of the hydraulic cylinders or other corresponding actuating means for initiating the swivelling operation, such as swivel drives including electric motors, hydraulically operated spindles etc., permits to move the platform 1 in the lifted state in any horizontal direction or even to turn to a certain extent so that a later alignment of the platform with respect to the hull members 6, 8 is possible.

In the aforedescribed embodiments the platform was supported on the brackets. As an alternative to that, the platform 1 or an upper part of the supporting structure 2 could also be hung up on the lifting means 16 as described for instance in WO 98/24980 A1.

Figure 6:
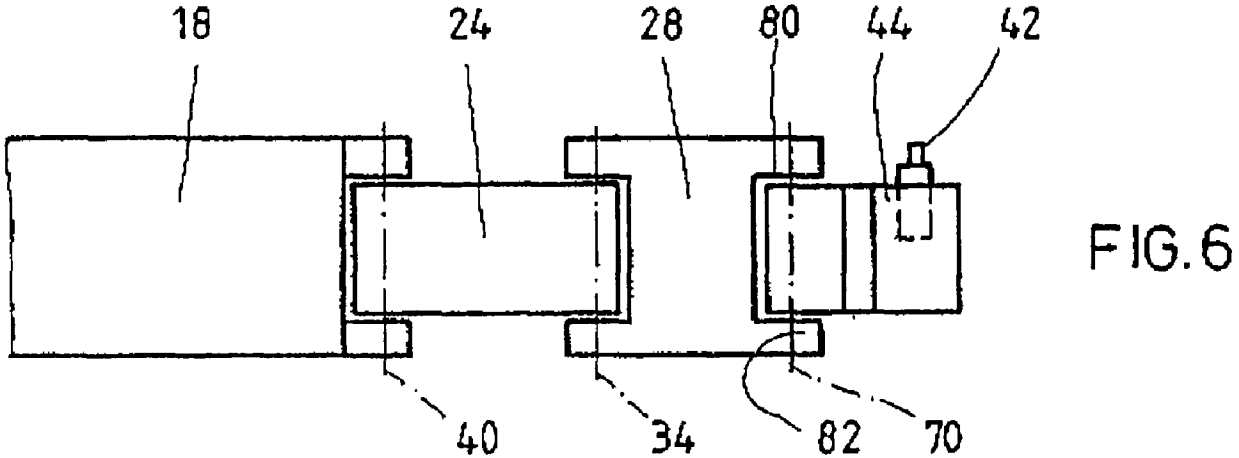
FIG. 6 is a side view of another embodiment of a bracket.

FIG. 6 shows a further variant of the support means represented in the FIGS. 2 to 4 in which the outer articulated arm 28 is provided with a further swivelling axle 70 through which an end portion 44 is linked.

The structure of the bracket 18 and the swivel arm 24 substantially corresponds to that of the aforedescribed embodiment, wherein the joint design according to the FIG. 2 or 4 or corresponding designs can be employed.

Figure 7:
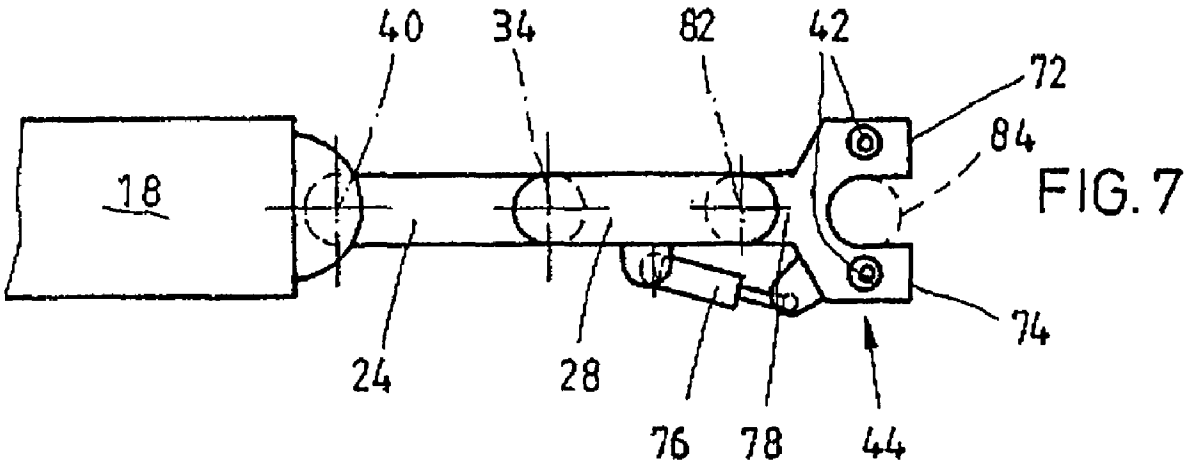
FIG. 7 is a top view on the bracket as shown in FIG. 6.

In accordance with the top view in FIG. 7 the end portion 44 has a fork-like design comprising two fork legs 72, 74 on each of which a lifting means, for instance a hydraulic cylinder 42, is supported.

The two fork legs 72, 74 converge into a central leg 78 which is encompassed by two joint clips 80, 82 of the articulated arm 28 in the variant represented in FIG. 6.

The end portion 44 is swivelled with respect to the articulated arm 28—as in the aforedescribed embodiments—for instance by a swing cylinder 76 which is supported, on the one hand, on the articulated arm 28 and, on the other hand, acts upon the end portion 44.

Of course, the end portion 44 can also be designed to have one single lifting means.

An adapter 84 indicated in dash-dot in FIG. 7 which in the lifting position is encompassed by the two fork legs 72, 74 so that a simple centering of the support means is possible with respect to the accommodation at the platform is provided at the platform or the supporting structure.

Similarly to the foregoing embodiments, the arms 24, 28 can likewise be swivelled vis-à-vis the bracket 18 via swing cylinders 45, 46.

When controlling the swinging movement by one or more swing cylinders the lifting means—the hydraulic cylinder or cylinders of the end portion 44 in the present case—is first aligned in the lifting position with respect to the adapter 84 of the platform or supporting structure and is pressed against the adapter 84 or the corresponding member of the platform by the swing cylinders applying little force. This pressing of the end portion 44 against the platform ensures that horizontal relative movements between the lifting ship and the platform are compensated.

Instead of the swing cylinder also another suitable biasing means can be used to maintain the relative position between the lifting means and the corresponding member of the platform/supporting structure. The aforementioned pressing force can be varied in response to the lifting operation of the platform by appropriately controlling the swing cylinders or the corresponding components so that for instance at a later time, i.e. after setting the hydraulic cylinders of the lifting means 42, the pressing force is reduced to zero so that the support means can move freely in the horizontal direction.

In principle, the component corresponding to the end portion 44 could also be connected directly to the swivel arm 24 so that again—as in the case of the embodiments shown in FIGS. 2 to 4—merely two vertical swivelling axles are provided.

There is disclosed a support means, especially for mounting or dismounting an offshore platform comprising an articulated bracket which is movable by horizontally swinging its two articulated arms. In the case of a rather rough sea a compensating movement in the horizontal direction can be brought about by appropriately controlling the articulated arms, wherein the reaction forces acting in the horizontal direction are minimal.

Although the best mode contemplated by the inventors of carring out the present invention is disclosed above, practice of the present invention is not limited thereto, It will be manifest that various additions, modifications and rearrangements of the features of the present invention may be made without deviating from the spirit and scope of the underlying inventive concept.

What is claimed is:

1. A support for mounting or dismounting an offshore platform, the support comprising at least one bracket having a free end portion,the free end portion including a lifting means for acting upon the platform, wherein the bracket can be brought out of a home position at the side of the platform into a lifting position, characterized in that the bracket is flexibly linked to a floating body and has at least one articulated arm linked to a swivel arm which can be swiveled about a swivel axel approximately in the horizontal direction between the home position and the lifting position.

2. A support means according to claim 1, wherein the lifting means is support by an end portion linked to the articulated arm, and the swiveling axle of the support extends in the vertical direction.

3. A support according to claim 2, wherein the end portion has a fork-like shape and preferably supports a lifting means on each of its two fork legs.

4. A support according to claim 2, wherein the arms and actuated by actuating means.

5. A support according to claim 4, wherein the actuating means is at least one hydraulic cylinders.

6. A support according to claim 2, wherein a bearing arrangement is disposed in the area of the swiveling axle and includes at least two bearing means spaced apart from each other one of which includes at least an axial bearing and a radial bearing.

7. A support according to claim 6, wherein the axial bearing comprises a piston guided in a cylinder with at least one of the arms and the end portion being supported on the piston.

8. A support according to claim 7, wherein the bearing means includes at least two axial bearings, the cylinders of which are hydraulically connected.

9. A support according to claim 8, wherein both bearing means are provided with axial bearings and the cylinder or cylinder of the one axial bearing is hydraulically connected to the cylinder of the other axial bearing.

10. A support according to claim 8, wherein the piston surfaces are different.

11. A support according to claim 7, wherein the piston is an annular piston which encompasses an axle of the bearing.

12. A support according to claim 2, wherein at least one of the arms and the end portion has two joint clips which encompass at least a joint projection of the other arm and another of the arms and the end portion in the axial direction, wherein a play is provided in this direction.

13. A support according to claim 1, wherein the arms are actuated by actuating means.

14. A support according to claim 13, wherein the actuating means are hydraulic cylinders.

15. A support according to claim 9, wherein the piston surfaces are different.

* * * * *

UNITED STATES PATENT AND TRADEMARK OFFICE

CERTIFICATE OF CORRECTION

PATENT NO. : 7,465,126 B2
APPLICATION NO. : 10/239006
DATED : December 16, 2008
INVENTOR(S) : Werners et al.

It is certified that error appears in the above-identified patent and that said Letters Patent is hereby corrected as shown below:

Title Page, Item (57) Abstract: Please delete "means" after "support" in the first (1st) sentence of the Abstract Column 1; line 17: Please add --a-- before "special"; please add --,-- after the 2nd word "ship"
Column 1; line 26: Please replace "diametrally" with --diametrically--
Column 2; line 7: Please add --the-- before "rails"
Column 2; line 15: Please delete the word "acting"

Claim 2; line 27: Please delete the word "means"
Claim 3; line 32: Please replace "a" with --the--
Claim 4; line 34: Please replace "and" with --are--
Claim 5; line 2: Please replace "cylinders" with --cylinder--
Claim 9; line 15: Please delete "cylinder or"
Claim 12; line 24: Please delete "the other arm and"

Signed and Sealed this

Tenth Day of March, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,465,126 B2
APPLICATION NO. : 10/239006
DATED : December 16, 2008
INVENTOR(S) : Werners et al.

It is certified that error appears in the above-identified patent and that said Letters Patent is hereby corrected as shown below:

Title Page, Item (57) Abstract: Please delete "means" after "support" in the first (1st) sentence of the Abstract Column 1; line 17: Please add --a-- before "special"; please add --,-- after the 2nd word "ship"
Column 1; line 26: Please replace "diametrally" with --diametrically--
Column 2; line 7: Please add --the-- before "rails"
Column 2; line 15: Please delete the word "acting"

Column 7, Claim 2; line 27: Please delete the word "means"
Column 7, Claim 3; line 32: Please replace "a" with --the--
Column 7, Claim 4; line 34: Please replace "and" with --are--
Column 8, Claim 5; line 2: Please replace "cylinders" with --cylinder--
Column 8, Claim 9; line 15: Please delete "cylinder or"
Column 8, Claim 12; line 24: Please delete "the other arm and"

This certificate supersedes the Certificate of Correction issued March 10, 2009.

Signed and Sealed this

Thirty-first Day of March, 2009

John Doll

JOHN DOLL
*Acting Director of the United States Patent and Trademark Office*